United States Patent [19]

Kallmann et al.

[11] Patent Number: 4,979,360

[45] Date of Patent: Dec. 25, 1990

[54] TRANSPORT AND HANDLING SYSTEM FOR MULTI-POSITION TEXTILE MACHINES

[75] Inventors: Jurgen Kallmann, Kaarst; Heinz Fink, Krefeld, both of Fed. Rep. of Germany

[73] Assignee: Palitex Project Company GmbH, Krefeld, Fed. Rep. of Germany

[21] Appl. No.: 482,795

[22] Filed: Feb. 21, 1990

[30] Foreign Application Priority Data

Mar. 3, 1989 [DE] Fed. Rep. of Germany ..... 3906718

[51] Int. Cl.[5] ..... D01H 9/18

[52] U.S. Cl. ..... 57/281; 57/268; 57/270; 57/276; 104/89; 104/91

[58] Field of Search ..... 57/266–268, 57/270, 274, 276, 281; 104/89, 91, 93–96

[56] References Cited

U.S. PATENT DOCUMENTS

| | | | |
|---|---|---|---|
| 3,534,539 | 10/1970 | Franzen et al. | 57/281 |
| 3,828,682 | 8/1974 | Klein | 104/91 |
| 3,935,821 | 2/1976 | Maier et al. | 104/89 |
| 4,023,339 | 5/1977 | Laderach et al. | 104/91 X |
| 4,720,967 | 1/1988 | Guttler | 57/281 |
| 4,735,042 | 4/1988 | Igel | 57/281 |
| 4,841,719 | 6/1989 | Sasaki et al. | 57/276 X |
| 4,848,077 | 7/1989 | Kawarabashi et al. | 57/281 |
| 4,856,270 | 8/1989 | Langen et al. | 57/89 X |

FOREIGN PATENT DOCUMENTS

| | | |
|---|---|---|
| 1510865 | 7/1970 | Fed. Rep. of Germany . |
| 2556702 | 7/1976 | Fed. Rep. of Germany . |
| 2521370 | 11/1976 | Fed. Rep. of Germany . |

*Primary Examiner*—John Petrakes

*Attorney, Agent, or Firm*—Bell, Seltzer, Park & Gibson

[57] ABSTRACT

A transport and handling system for multi-position textile machines, in particular twisting machines, comprising a first track system, the path of which extends along the longitudinal sides of the machines, and which accommodates at least one automated handling device to perform servicing operations, and further comprising a second track systems, the path of which extends likewise along the longitudinal sides of the machines, and along which transport devices travel, which are adapted to be combined to trains and to receive working materials and/or working means. The paths of the two track systems extend parallel to each other over at least a portion such that the automated handling device is adapted to both engage with the transport devices and move past same. The automated handling device possesses a coupling drive means to carry the transport devices along portions of the path extending parallel to each other and to produce relative movements between the automated handling device and the transport devices both when the automated handling device is stopped and when it is moved.

11 Claims, 7 Drawing Sheets

TRANSPORT AND HANDLING SYSTEM FOR MULTI-POSITION TEXTILE MACHINES

FIELD OF THE INVENTION

The invention relates to a transport and handling system for multi-position textile machines, in particular twisting machines, having the characteristics as described herein.

BACKGROUND OF THE INVENTION

The operations, which an automated handling device performs on a twisting machine, may, for example, comprise both the changing of feed yarn packages and/or doffing of takeup packages and the supply and removal of winding tubes, yarn finish tanks or the like. Likewise, the working materials and/or working means received by the transport devices may include, for example, packages, tubes, yarn finish tanks and the like.

Known are package transport systems, which convey, for example, feed yarn packages for twisting machines into the machines and remove takeup packages from the machines. It is further known to use automated handling devices for changing packages on textile machines, which permit to automate a package change operation. A problem with these procedures exists in the adjustment of the mode of operation of the transport system to that of the automated handling device in such a manner that a sufficient number of packages is available to the automated handling device within the shortest possible times at the positions which are to be changed. This applies to both an operation with so-called random changes, in which the packages are changed at positions being relatively far removed from each other and requiring a change, and an operation with block changes, in which all packages on a machine or a portion thereof are changed.

It is already known to effect an interlinkage of the package transportation and the automated operations on a machine by the control of a computer. However, even in such an instance there exists the problem of conveying packages by the transport system within short periods of time to the positions, where they are needed by the automated handling device.

Disclosed in German Patent No. 1 510 865 is an apparatus for two-for-one twisting machine for an automatic change of package units by means of a carriage traveling along the machine, which comprises a magazine for receiving the packages and a gripper, which assists in transporting the packages from the spindles of the machine to the magazine and vice versa. In this known apparatus, the automated handling device carries along a certain number of packages by the socalled "piggyback method" in the magazine, which is arranged together with the automated handling device on the carriage. The apparatus has the disadvantage that the number of the packages, which it carries along, is relatively limited, and that because of its limited carrying capability the apparatus is suitable to perform only random changes on the machine. The numerous reloading operations required on the magazine are very time consuming, so that the apparatus is unsuitable for a fully automated operation, which also includes the change of a block of packages.

A device having the characteristics described herein is disclosed, for example, in German Offenlegungsschrift No. DE-OS 25 21 370. In this known apparatus for the automatic doffing of bobbins or donning of tubes on spinning and twisting machines, the bobbins are supplied to the automated handling device by storage buggies which can be combined to a transport train. The automated handling device is adapted to engage with the transport train and pull same along. However, it can also travel along the stopped transport train when it is disengaged from the latter. Such an apparatus is primarily suitable for a block change, in which the automated handling device positions one or more storage buggies at a predetermined longitudinal side of the machine, travels along the stopped transport train and effects a change of the packages. The apparatus is less suitable for a random change, inasmuch as for each change to be carried out the automatic servicing apparatus would have to move first the transport train to a certain position, in which a buggy loaded with packages is located at a position to be changed, so as to then move to the position to be change and carry out the package change. Such a method necessitates a substantially higher expenditure of controls and time.

OBJECT AND SUMMARY OF THE INVENTION

It is the object of the present invention to design and construct a transport and handling system having the characteristics as defined in the preamble of claim 1 such that an adequate number of packages is available to the automated handling device within shortest possible times for carrying out both a block change and a random change.

The invention proceeds from the fact that a quasi-continuously operating transport system exists for making available an adequate number of packages and the like without time-consuming reloading operations. On the other hand, the packages are to be changed by a traveling automatic handling device. The basic concept of the invention comprises a direct association of the movements of the automated handling device to the movements in the transport system. An important basic condition is that the paths of a first track system, along which the automated handling device travels, and those of a second track system, along which transport devices travel, must extend in such a manner that the automated handling device has direct access to the transport system at any position at which a package is to be changed.

Within the system, the automated handling device itself serves as a drive mechanism for the transport train and is designed and constructed so that it cannot only pull and push the transport train, but also move the latter, according to the present invention, relative to its own position both when it is stopped and when it moves itself.

In such an embodiment, it is particularly advantageous to design and construct portions of the path, along which the automated handling device directly drives the transport train, in such a manner that the rails of the two systems are integrated in a common track.

Preferably, the transport system is an overhead conveying system, and the automated handling device is likewise arranged by a suspension-type mounting method. However, in principle also combinations of another transport system and a correspondingly arranged automatic handling device are possible.

The system of the present invention allows a greatly variable association of the transport trains to one or more automated handling devices with respect to the quantity to be transported, the location and the time. Without any major readjustments on the apparatus, the system further allows to perform both a block change and a random change.

Another advantage of the system of the present invention is that the packages need not be arranged on the transport devices at distances adapted to the spindle gauge of the machine. Thus, it is made possible to set up the transport devices in a space-saving manner.

BRIEF DESCRIPTION OF THE DRAWINGS

The following will describe an embodiment of a transport and handling system according to the present invention with reference to the attached drawings, in which.

DETAILED DESCRIPTION OF PREFERRED EMBODIMENTS OF THE INVENTION

Figure 1:
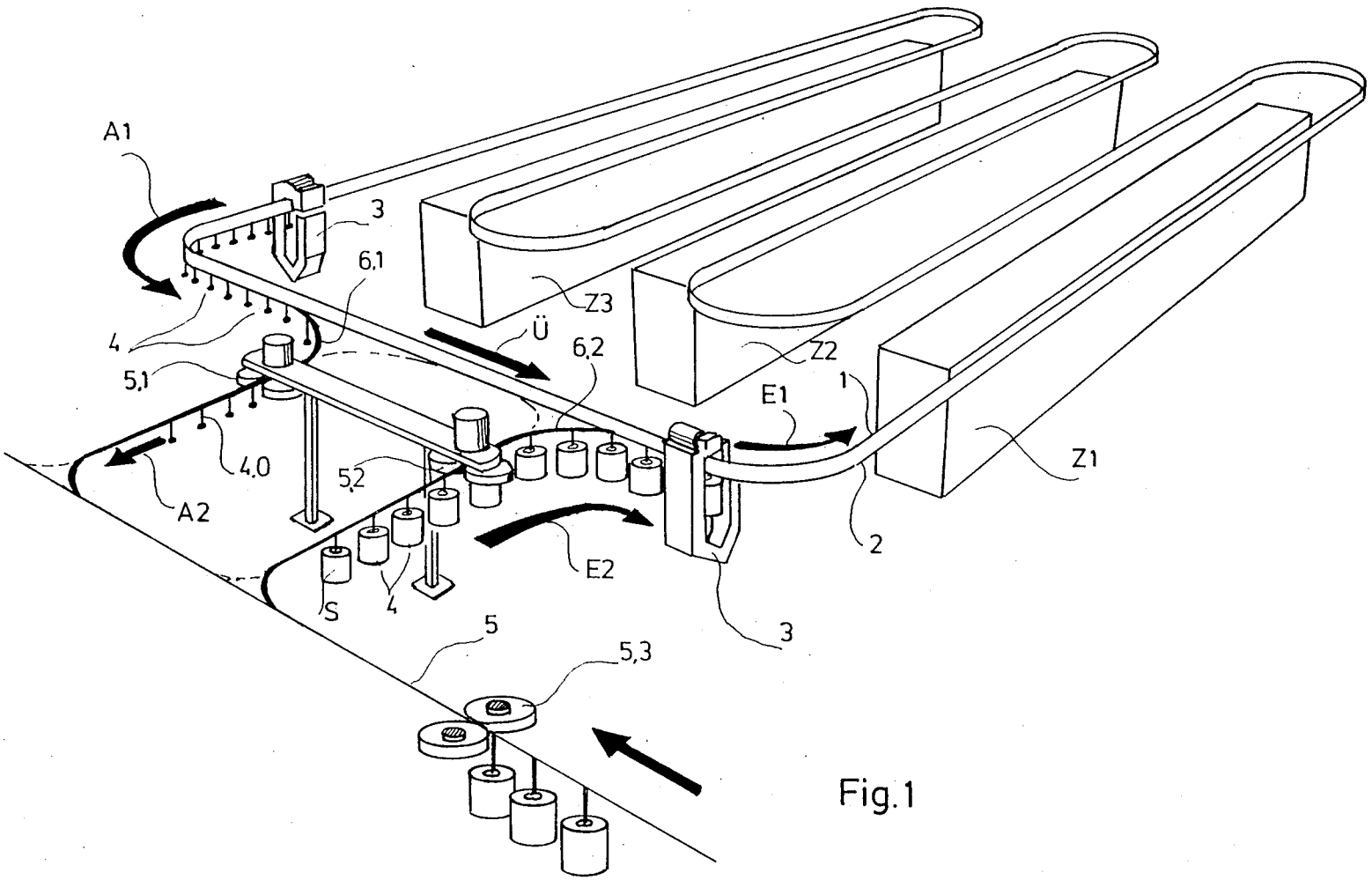
FIG. 1 is a schematic, perspective view of a multi-position machine installation with a transport and handling system.

Illustrated in FIG. 1 is multi-position machine installation comprising three machines Z1, Z2 and Z3, which may, for example, be two-for-one twisting machines. Two track systems extend through this installation, i.e., a first track system 1, which meanders through the machine installation along all longitudinal sides of the machines, and along which one or more automated handling devices 3 travel, which change the packages on the machines Z1, Z2, Z3. An embodiment of the automated handling devices 3 and the arrangement thereof on the first track system 1 will be described in greater detail hereinbelow.

Furthermore, a second track system 2 is provided, whose path likewise meanders through the machine installation Z1, Z2, Z3, parallel to the path of the first track system 1. As will be described in more detail hereinbelow, the rails of the second track system 2 in the entire region of the machine installation are combined with the rails of the first track system to a common track. Along the second track system 2 devices of a transport system travel, which is designed and constructed as an overhead suspension system, as will be described in more detail hereinbelow. The individual transport devices 4.0, each of which can carry one or two packages S, are coupled together to form a longer transport train 4.

Facing the front end of the machine installation Z1, Z2, Z3 is a superposed transport system 5, which comprises the same tracks and the same transport devices as the second track system 2 and can form, for example, a "package depot," which receives the transport flows from the winding or assembly winding room. The second track system 2 is connected, via switch elements 6.1 and 6.2, with the superposed transport system 5.

Within the superposed transport system 5, the transport trains 4 are moved on by means of friction wheel drives 5.1, 5.2, 5.3 stationarily installed along the path. At the junctions of the superposed transport system 5 with the second track system 2, the transport trains 4 are taken over by the automated handling device 3 and advanced by the latter. Illustrated in FIG. 1 is the way how the automated handling device 3 moves into the installation in direction of arrow E1 and, in doing so, pulls the transport train 4 behind it out of the superposed transport system 5 in direction of arrow E2 via a switch element 6.2. Along its path through the machine installation, the automated handling device 3 can change its relative position to the transport train at any time, also during the travel, so that, for example, after having delivered packages, as is likewise shown in FIG. 1, it now pushes the empty transport train 4 ahead of itself in direction of arrow A1, via a switch element 6.1, out of the machine installation and in direction of arrow A2 into the superposed transport system 5.

Shown in FIG. 1 is the train with the empty transport devices 4.0 as it is pushed out of the machine installation. Naturally, in this instance it is also possible that the empty transport devices 4.0 carry unwound tubes of feed packages.

As soon as the exiting transport train, which engages with the friction wheel drive 5.1 of the superposed transport system 5, has entirely moved out of the second track system 2, the switch elements 6.1 and 6.2 are correspondingly changed, so that the automated handling device 3 can continue to travel along the first track system 1 in direction of arrow Ü. After another change of the switch element 6.2, the automated handling device takes over a new transport train 4 loaded with full packages, which is pushed by means of a friction wheel drive 5.2 from the superposed transport system 5 into the track system 2 after a corresponding change of the switch element 6.2 and moves with this new transport train through the machine installation.

Depending on the size of the machine installation Z1, Z2, Z3, one or more combinations comprising automated handling devices and transport trains move into the machine installation. While in the machine installation itself, the demand can be controlled by machine-integrated computers, which are connected to a master computer. However, in the case of simple systems it is also possible to control the installation by mechanical or optical recognition between the automated handling device and a working position of the machine, which is waiting for service.

The embodiment illustrated in FIG. 1 possesses two systems of rails integrated in a common track.

Figure 1A:
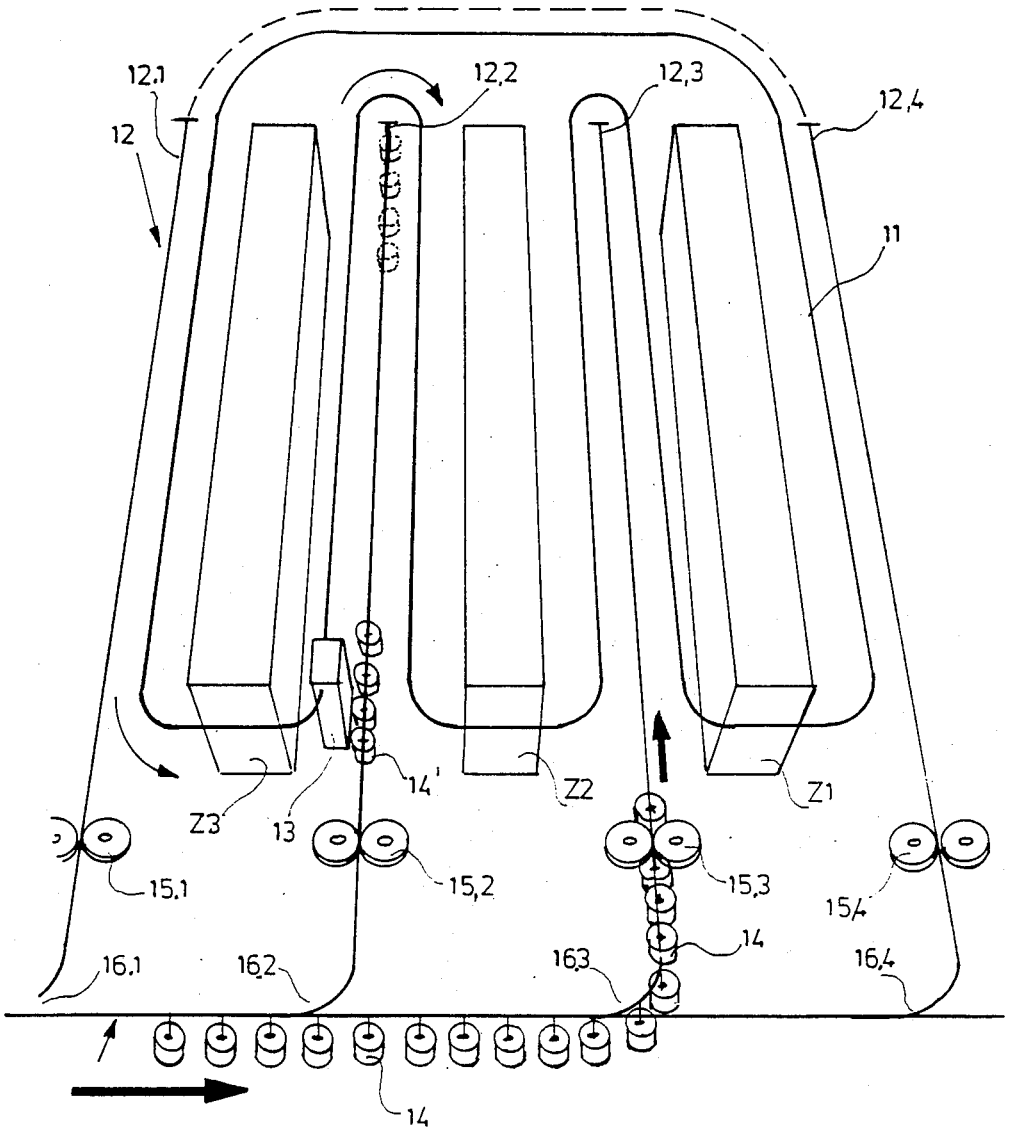
FIG. 1*a* is a view analogous to FIG. 1 of a multi-position machine installation with a different embodiment of a transport and handling system.

The following will describe an embodiment with reference to FIG. 1*a*, in which the two track systems extend separate from each other over their entire length.

Illustrated in FIG. 1*a* is a multi-position machine installation comprising three machines Z1, Z2 and Z3, which may comprise two-for-one twisters as in the foregoing embodiment. Along a first track system 11, which meanders through the machine installation along all longitudinal sides of the machines, one or more automated handling devices 13 travel, and change the packages on machines Z1 to Z3.

A second track system, which is indicated in its entirety by numeral 12, likewise extends into the machine installation. However, the rails of this system are not combined with the first track system 11, but are constructed as a separate track. In this instance, it is not possible to meander the second track system 12 parallel to the first track system through the machine installation, since the tracks of the two rail systems describe different radii at the reversal points of the meander. If so, it would be extremely expensive to adjust the operating speed of the automated handling device 13 to the transport devices for the packages, which are combined to a train 14 and move along the second track system. Furthermore, considerable space at the head ends of the machine installation would be needed to accommodate the sweeping curvatures. Likewise, it would be necessary to substantially widen the aisles between the machines.

In order to accomplish the endeavored coordination of the movements of the automated handling device 13 with the movements of the transport train 14, the second track system 12 fans out in a number of tracks 12.1 to 12.4, Which each extend along the longitudinal sides of the machines Z1 to Z3 in such a manner that they lie in the loops of the meandering first track system 11, so that, for example, the tracks 12.2 and 12.3 each arranged between two machine face each on both sides a section of the first track system 11 extending parallel thereto, and that the automated handling device 13 can remove packages from both sides of the transport train.

As is shown in dotted lines in FIG. 1*a*, the two tracks 12.1 and 12.4 extending along the outer sides of the installation may be interconnected.

The tracks 12.1 to 12.4 of the second rail system 12 are connected, via switch elements 16.1 to 16.4 to a superposed transport system 15, along which the transport trains 14 are moved on by means of friction wheel drives 15.1 to 15.4 stationarily installed along its path. The transport devices of the trains 14 are delivered, for example, from a winding or assembly winding machine not shown, and are combined to transport trains behind a package transfer station likewise not shown.

Also in this embodiment it is possible to design and construct the automated handling device 13 in a manner not specially shown so that it takes over and moves on the transport trains 14 entering into the tracks 12.1 to 12.4, it being able to change its relative position to the transport train 14 at any time.

Thus, for example, FIG. 1*a* shows a transport train 14 entering into the track 12.3, while the automated handling device is still in the region of track 12.2, where it has completed, for example, its work on a shorter transport train 14'. The automated handling device 13 now moves in direction of the entering transport train 14 until it reaches the portion of the first track system 11, which extends parallel to the track 12.3 The movements of the transport train 14 and the automated handling device are coordinated so that at the moment, when the differential speed is about 0, the automated handling device 13 engages mechanically with the transport train 14. As in the foregoing embodiment, the automated handling device 13 has its own drive for the transport train 14, which it can also displace relative to itself during its movement. This occurs always when the automated handling device 13 has to change packages on the twisting machines.

At the end of track 12.3, the automated handling device 13 disengages from the transport train 14. The automated handling device 13 travels along the curve of the meander and engages again with the transport train 14, which it then moves back and finally pushes same again into the superposed transport system 15. Then, the transport train 14 engages again with the friction roll drive 15.3 and is moved on by the latter. The automated handling device can now travel, for example, along the curve of the meander lying ahead of it and take over in a manner not shown a transport train moving into the track 12.4. However, it can also return and take over a transport train, which enters, for example, into track 12.2 or 12.1. The embodiment of the track systems illustrated in FIG. 1*a* allows to carry out both a random change and a block change of the packages.

When performing a random change, one or more automated handling devices 13 travel along the first track system 11 respectively to the positions, on which a package change is to be effected. In so doing, they are can take over transport trains at each entry point of the tracks 12.1 to 12.4 of the second rail system 12, or they pick up the packages from transport trains, which have already entered into the tracks during an earlier cycle.

When performing a block change, it is basically not necessary that the automated handling device engage with the transport train. In this instance, it is possible to push the transport train into one of the tracks 12.1 to 12.4, and the automated handling device 13 can be called independently thereof to one of the longitudinal sides of the machines Z1 to Z3, or it automatically passes by this longitudinal side during its routine travels. Upon its arrival, it can work along the transport train and carry out the necessary package changes one after the other. As soon as the packages are removed from the transport train, same can be withdrawn by means of the friction wheel drives 15.1 to 15.4 from the respective track. Subsequently, the automated handling device 13 can travel to another longitudinal machine side so as to perform there the next block change.

The following description with refer to further details of the system of FIG. 1.

As can be seen in general in FIGS. 2–6, the first track system 1 comprises I beams, from which the automated handling device 3 suspends, whereas the second track system 2 and the superposed transport system 5 comprise hollow sections which are slotted at their underside. The hollow sections of the second track system 2 are each attached to the lower flange of the I beam of track system 1.

Figure 2:
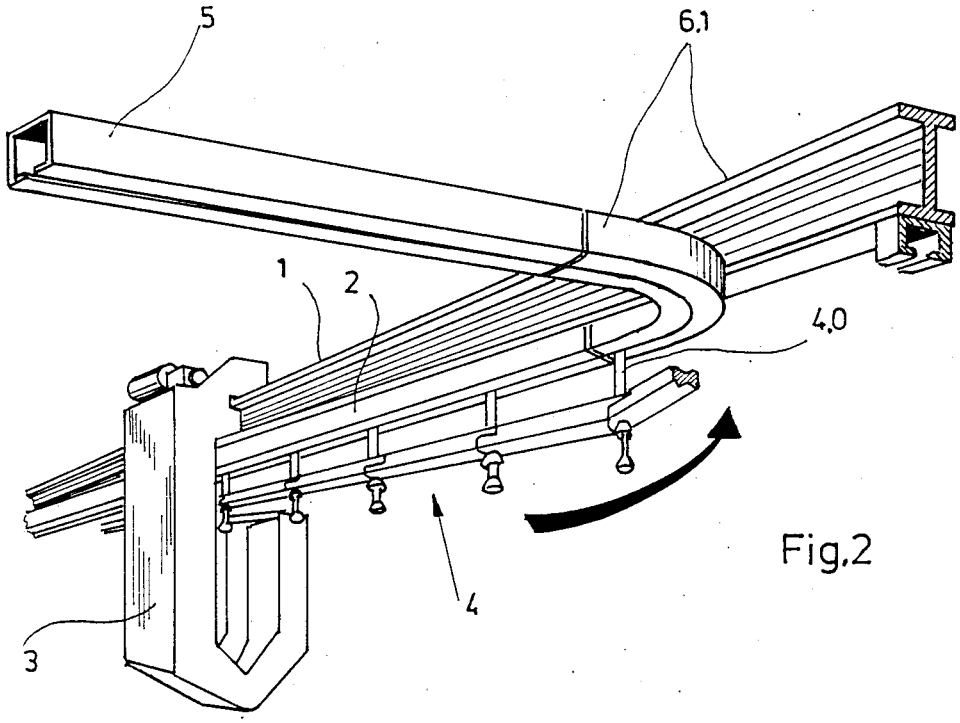
FIGS. 2 and 3 are each an enlarged and detailed perspective view of the connecting point of the transport system of FIG. 1 to a superposed transport system.
Figure 3:
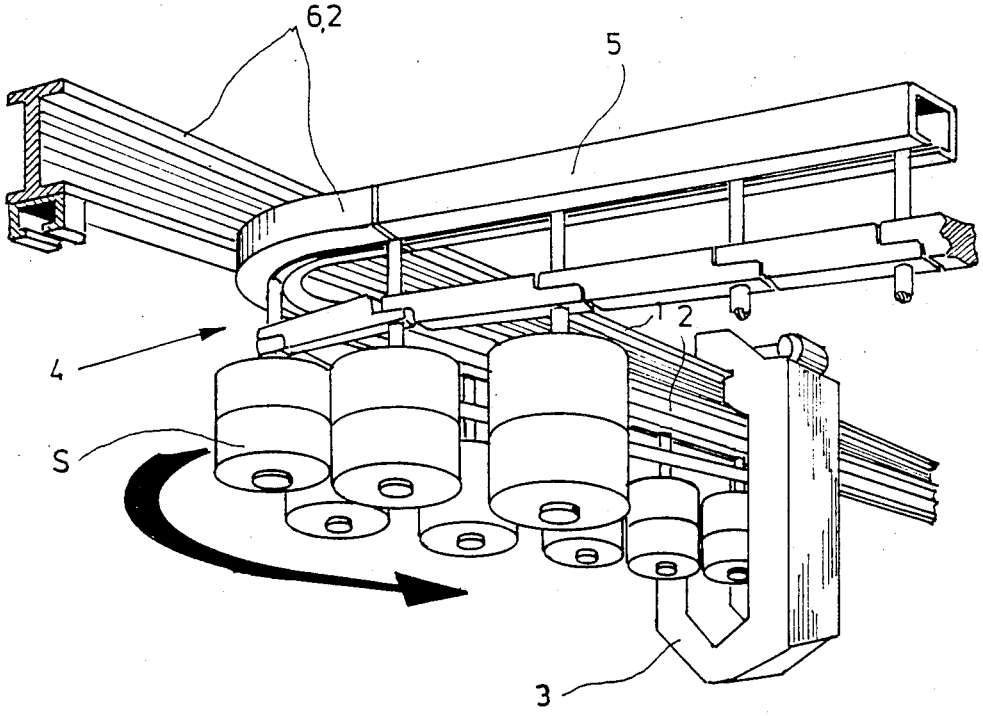

FIGS. 2 and 3 show the connection points between the second track system 1 and the superposed transport system 5 in the region of the switch elements 6.1 and 6.2. As can be noted, only each track system 2 has a curved switch portion, whereas the track system i extends in a straight line. According to FIG. 2, the automated handling device 3 pushes the train 4 composed of empty transport devices 4.0 over the switch element 6.1 into the superposed transport system 5, in which the train is moved on, as previously described, by a friction roll drive. After moving again into a straight-line section subsequent to the switch element 6.1, the automated handling device 3 continues to travel along its straight-line path and finally takes over, according to FIG. 3, the transport train 4, which carries packages S and has approached via switch element 6.2.

Naturally, it is also possible that the automated handling device 3 circulates several times with a transport train 4 not fulled emptied and with the switch elements 6.1 and 6.2 being in a corresponding position through the track systems 1 and 2, until the supply of packages on the transport train is exhausted.

Figure 4:
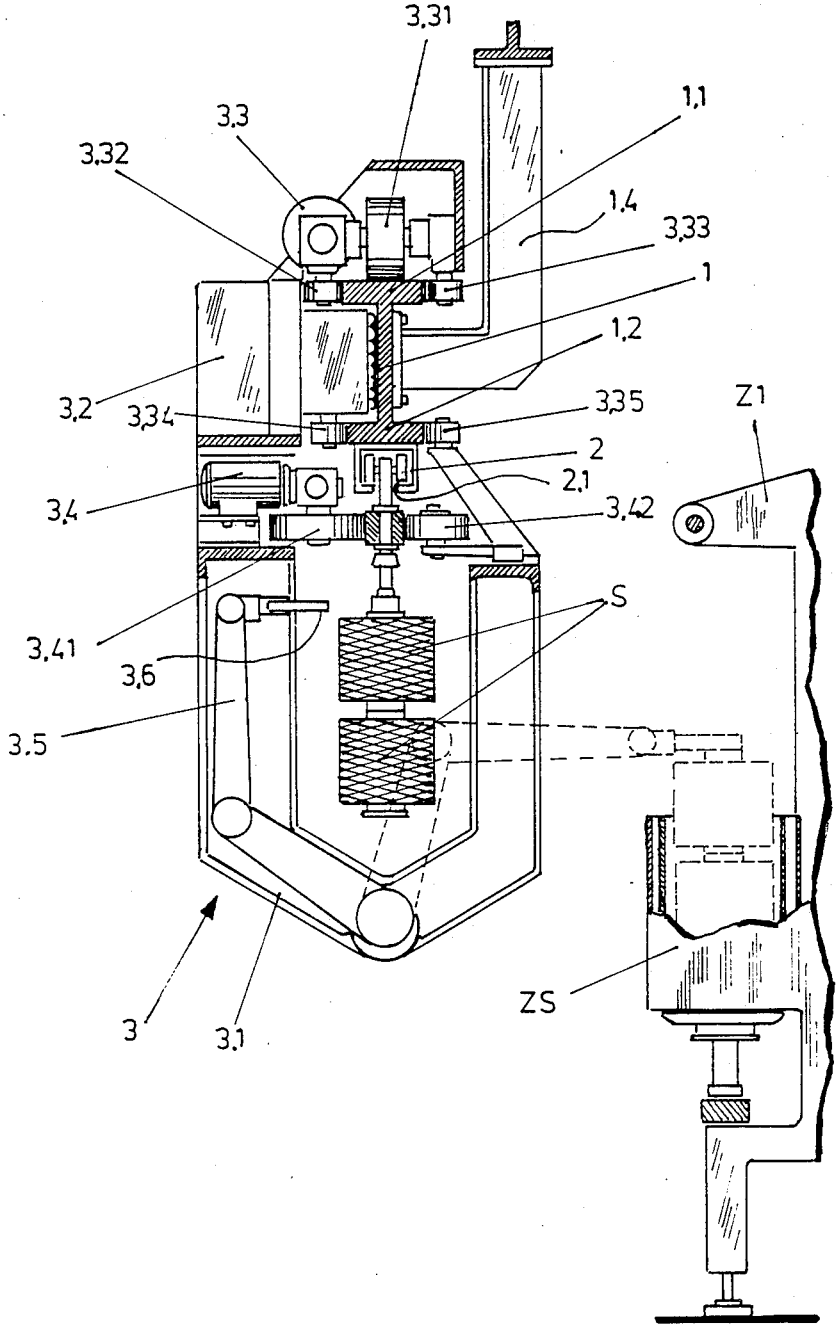
FIG. 4 is a vertical, partial sectional view of an automated handling device of the system of FIG. 1.

The precise type of suspension of the automated handling device 3 on the first track system 1 and of the transport train on the second track system 2 can be seen in FIG. 4.

The automated handling device 3 comprises a substantially U-shaped frame 3.1. One upwardly extending leg of the frame accommodates a mounting support 3.2 for a first drive motor 3.3, which drives a drive wheel 3.31 located on the upper side of the upper flange 1.1 of the I beam, whereas guide wheels 3.32 and 3.33 engage on the two side surfaces of the upper flange 1.1. The 1 beam 1 is mounted, via mounting supports 1.4, for example, on a support frame not shown.

Arranged on the underside of the lower flange 1.2 of the I beam 1 is the hollow section of the track system 2, along which transport devices 4.0 travel. Each transport device 4.0 possesses (see, FIG. 5) a carrying arm 4.1, which extends through a slot 2.2 into the hollow section 2 and is suspended therein by means of guide rolls 4.2. Arranged on the lower end of the carrying arm 4.2 is a holding means 4.3 for one or two packages 8. Furthermore, the carrying arm 4.2 accommodates a drive coupling element 4.4, which comprises a flat band portion extending in the horizontal direction with a stepped portion 4.43 at its one end and a complementary stepped portion 4.44 at its other end. One of these stepped end portions contains in addition a slot not shown to permit the carrying arm 4.1 to pass therethrough in such a manner that the drive coupling elements 4.4 form a continuous band, when several transport devices 4.0 engage with each other. Furthermore, each drive coupling element 4.4 has vertical side surfaces 4.41 and 4.42, which are guide surfaces and likewise form two continuous guide surfaces along the transport train 4 in the joined condition of the transport devices 4.0. A second friction roll drive, which is arranged on the automated handling device 3, engages with these guide surfaces, and comprises a drive motor 3.4 and a friction wheel 3.41, which engages with the guide surface 4.41. Further included in said drive is a guide wheel 3.42, which engages with the opposite guide surface 4.42 and is connected with the frame 3.1 of the automated handling device 3.

Figure 5:
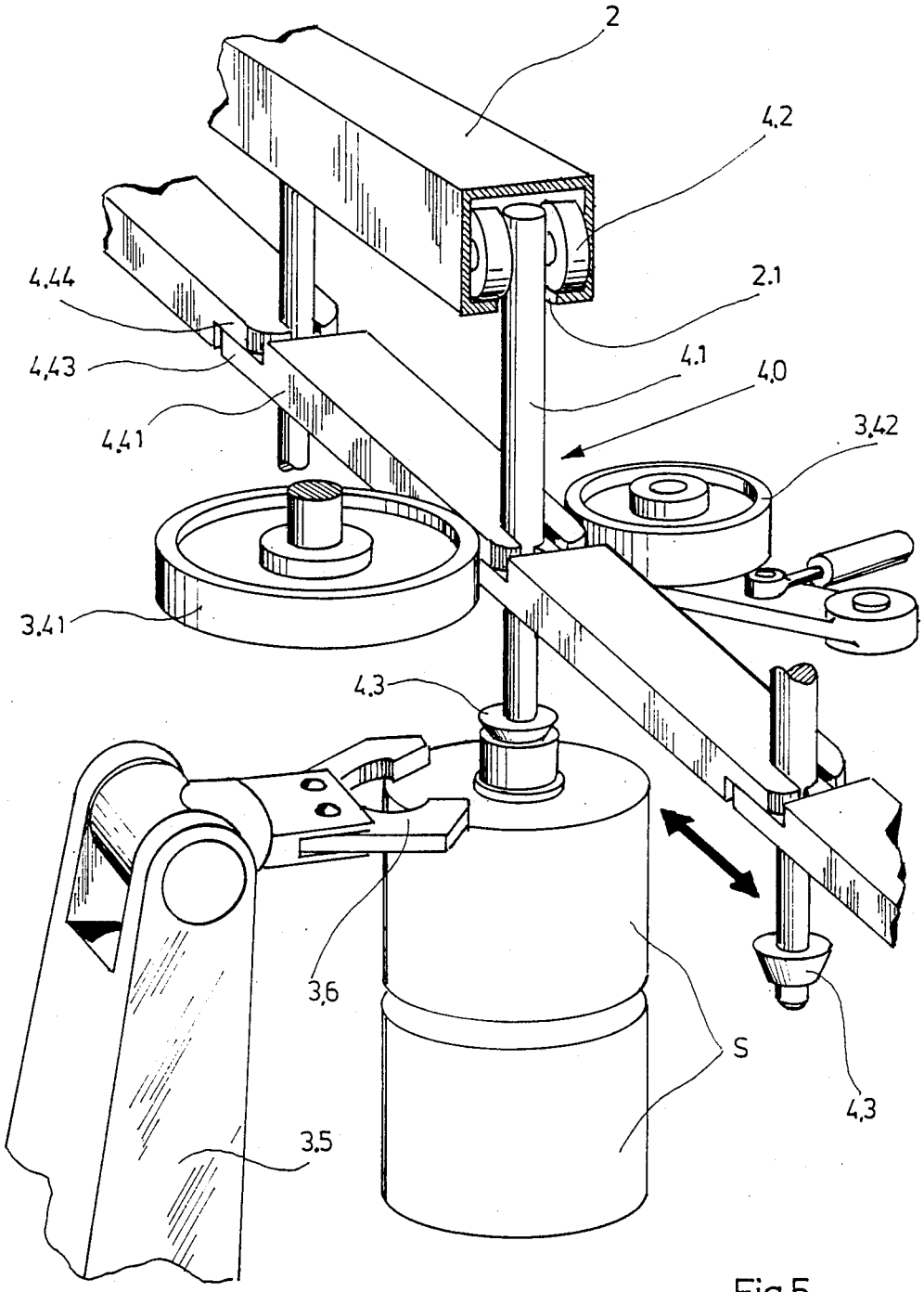
FIG. 5 is a perspective detail view of the drive mechanism between the automated handling device and the transport train in the system of FIGS. 1∝4.
Figure 6:
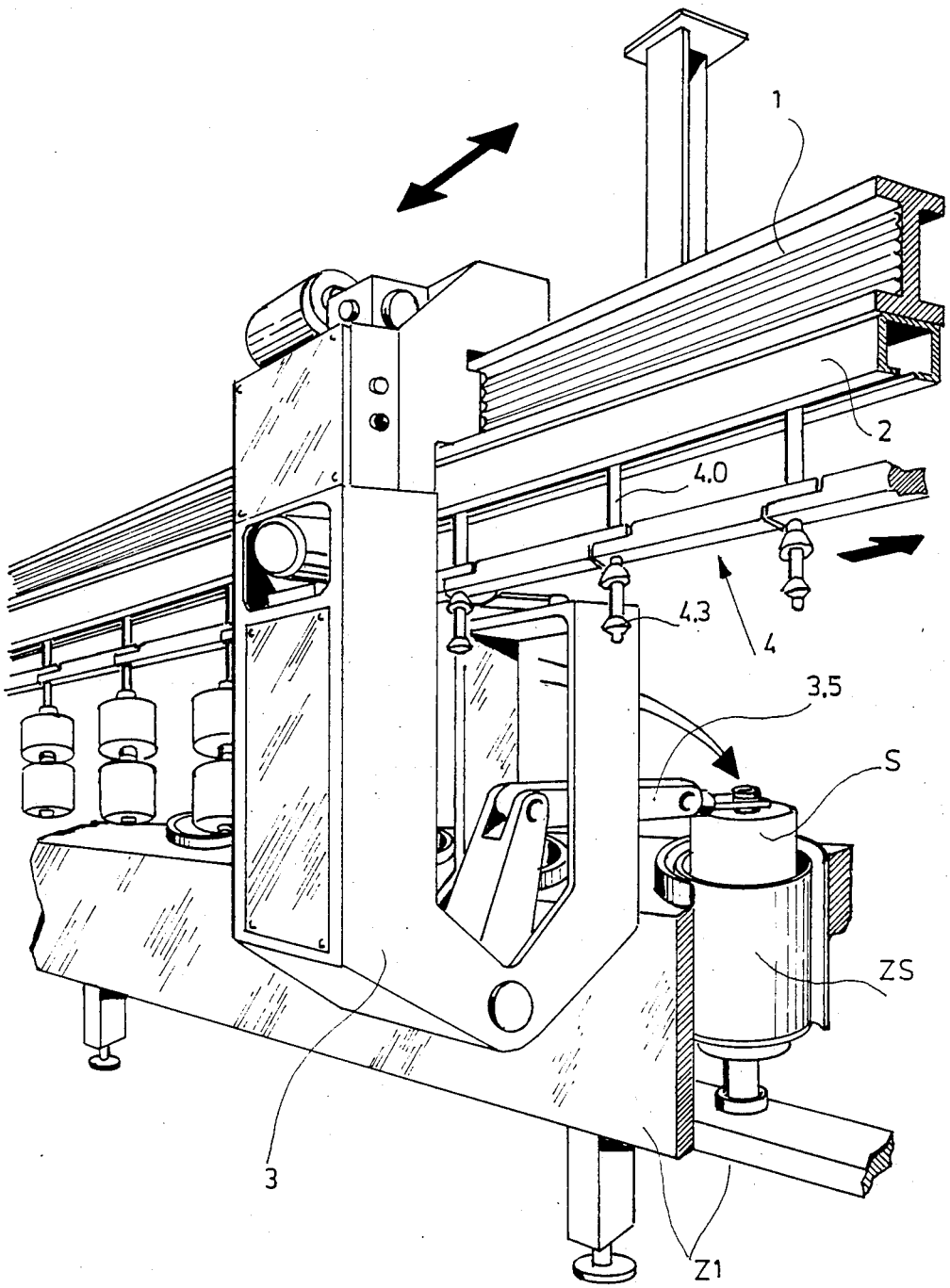
FIG. 6 is a perspective detail view of an automated handling device of the system of FIGS. 1–5 during a package change.

As can be noted from FIGS. 4 and 5, the automated handling device 3 also possesses a robot arm 3.5, which is pivotally arranged in the lowest point of the frame 3.1 and comprises a gripping device 3.6 at its free end. As can be seen in FIGS. 4 and 5, the robot arm 3.5 grasps a package unit S arranged on the transport device 4.0 and inserts same into the twisting spindle indicated at ZS. FIG. 4 shows in solid lines the robot arm 3.5 in its idle position, and in dotted lines in its position, in which the package S is inserted into the twisting spindle ZS. FIG. 6 shows this procedure one more time in a perspective view. In like manner, the robot arm 3.5 is adapted to first remove an empty winding tube and to suspend same on a vacant transport device 4.0.

In operation, the system proceeds, when a block change is performed, in such a manner that after having completed its activity at a working position, the automated handling device 3 displaces the transport train 4 relative to itself by one spindle gauge. Thus, after having moved on itself to the next working position, it has again at its disposal a transport device holding full packages so as to continue its servicing of the machine.

In the case of a random change, the automated handling device 3 routinely moves together with the transport train 4 through the machine installation Z1, Z2, Z3, and in so doing sees to it, by displacing the transport train 4 relative to itself, that a pair of packages is available for its next servicing operation.

However, in its cooperation with the transport train 4, the automated handling device 3 can also operate in such a modified manner that it advances the entire loaded transport train 4 relative to itself and then stops itself at the first working position waiting to be serviced.

Then, the automated handling device moves from one working position to another past the stopped transport train 4 until it reaches the last position of the transport train loaded with full packages. At this point, the automated handling device would now have to get again a new supply of packages. It does so in that it pulls on the empty transport train 4 in the fashion of a locomotive, and during the travel advances the latter again relative to itself until the train reaches, as is shown in FIGS. 1 and 2, the junction of the second track system 2 and the superposed transport system 5, at which the friction wheel drive 5.1 of the superposed transport system 5 engages with the transport train 4 in the manner already described hereinabove.

Figure 7:
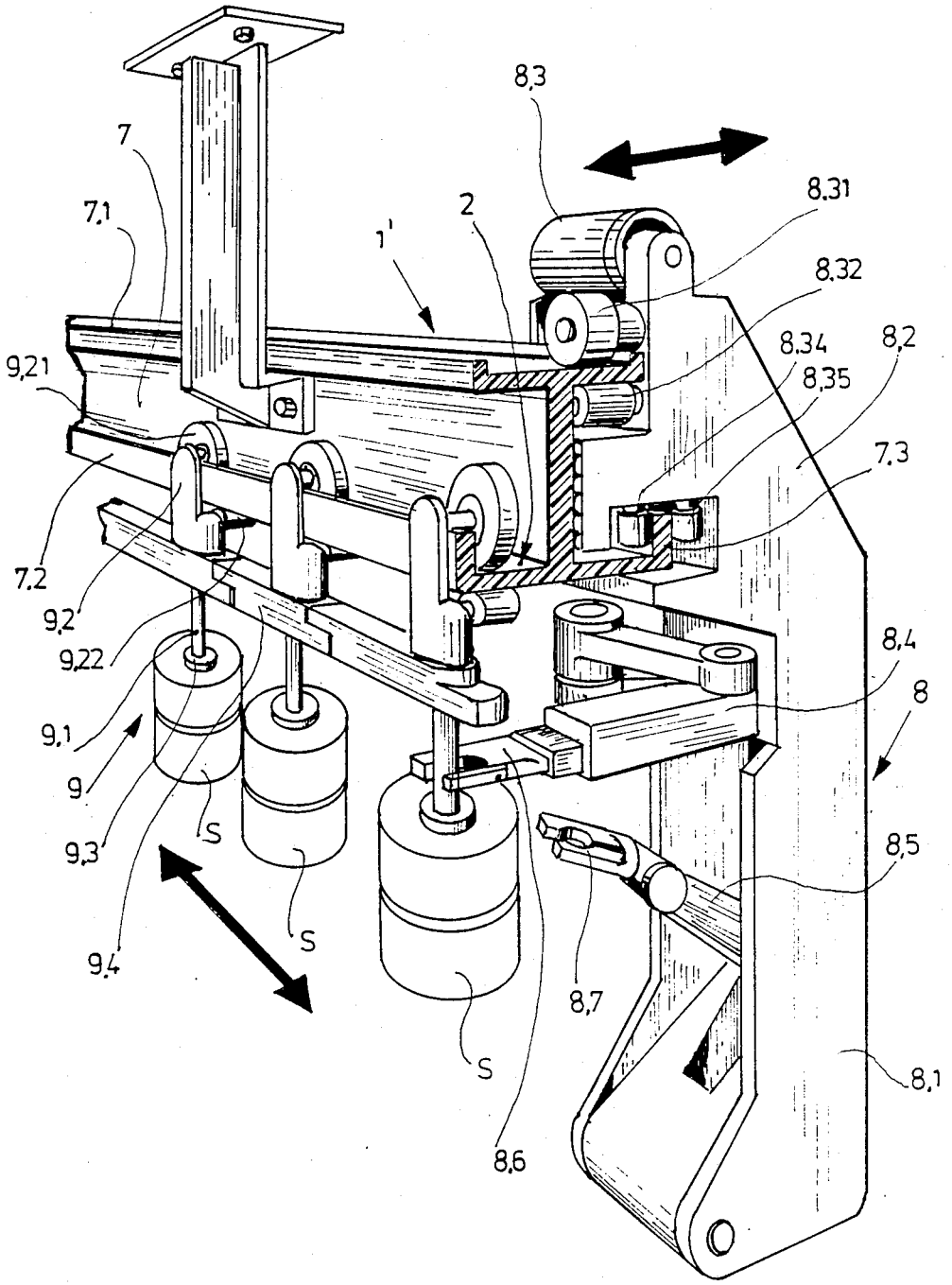
FIG. 7 is a perspective view of a different embodiment of an automated handling device and the track systems.

Shown in FIG. 7 is an embodiment of a transport and handling system, in which the rails of the second track system are combined with the rails of the first track system to a common track in a somewhat different manner than illustrated in FIGS. 2–6. Likewise, in this embodiment, the automated handling device differs somewhat in its design and construction.

The path of the two track systems may extend through a multi-position machine installation comprising several machines, for example, in a manner analogous to FIG. 1.

The embodiment of FIG. 7 comprises a first track system 1' and a second track system 2' arranged on a common I beam 7, with the carrying and guide surfaces of the first track system being located both on the upper flange 7.1 of the beam and on a bent portion 7.3 of the lower flange 7.2 of the beam. In this arrangement, the vertical center plane of the I beam 7 forms a separation between the two track systems, inasmuch as the running surfaces of the second track system 2' are arranged on the left side of the lower flange of the beam. Both track systems are designed and constructed as an overhead suspension system.

The automated handling device 8 comprises a frame 8.1, the upper portion 8.2 of which accommodates a drive motor 8.3 to drive a wheel 8.31, which is located on the upper side of the upper flange 7.1 of the beam and faces a track supporting wheel 8.32 contacting the underside of the lower flange 7.2. Furthermore, guide wheels 8.34 and 8.35 engage with a vertical portion 7.3 of the lower flange 7.2 of the beam.

Transport devices 9 carrying the packages S are each arranged on a carrying arm 9.1, which is provided on its upper end with a mounting support 9.2 for a carrying roll 9.21 arranged on the upper side of the lower flange 7.2 of the beam and a guide roll 9.22 contacting the underside of this lower flange. The lower end of the carrying arm accommodates a holder 9.3 to engage with the packages S. Also arranged on the carrying arm 9.1 is a coupling element 9.4, which comprises a flat band portion extending in horizontal direction with a stepped portion at its one end, similar to the embodiment of FIG. 5, and a complementary stepped portion at its other end, so that the coupling elements 9.4 form a continuous band when several transport devices 9 are joined one with the other.

Arranged on the frame 8.1 of the automated handling device 8 are two gripping arms 8.4 and 8.5, which are each provided at their front ends with a gripper 8.6 and 8.7, respectively. The upper gripping arm 8.4 of FIG. 7 serves as a coupling and drive mechanism between the automated handling device s and the transport train, which is formed by the transport devices 9. As such, the upper gripping arm 8.4 allows to engage the transport train with the automated handling device 8 so as to move along with the latter. Simultaneously, the upper gripping arm enables a relative movement between the automated handling device 8 and the transport train, thus forming a positive engagement between the automated handling device and the transport train.

The lower gripping arm 8.5 of FIG. 7 serves in a manner analogous to the description with reference to FIGS. 4 and 5 to remove the packages from the transport devices 9 and inserting same into a spindle of the machine not shown.

What is claimed is:

1. Transport and handling system for multiposition textile machines, in particular twisting machines, comprising a first track system, the path of which extends along the longitudinal sides of the machines and along which at least one automated handling device travels to perform servicing operations on the individual working positions of the machines; and further comprising a second track system, the path of which extends likewise along the longitudinal sides of the machines, and along which transport devices for receiving working materials and/or working means travel, which transport devices can be combined to trains, the automated handling device having a drive mechanism and a coupling means, and the paths of the two track systems extending parallel to each other at least over sections in such a manner that on the one hand the automated handling device can engage with the transport devices along these sections by means of the coupling devices and move past same on the other hand, characterized in that the automated handling device is provided with a frictional and positive coupling drive mechanism to entrain the transport devices along the parallel extending sections of the path as well as to generate between the automated handling device and the transport devices relative movements, which proceed from the automated handing device both when the latter is stopped and when it is moved.

2. Transport and handling system according to claim 1, characterized in that the second track system is connected at least at one point with a superposed transport system.

3. Transport and handling system according to claim 1 or 2, characterized in that the second track system is connected via switch elements to a depot comprising several tracks.

4. Transport and handling system according to claim 1, characterized in that the rails of the first and the second track system are integrated in a common track at least over a portion of the path, along which they extend parallel to each other.

5. Transport and handling system according to claim 4, characterized in that the rails of the first and the second track system are integrated in a common track along the entire path of the first track system, and that the rails of the second track system are connected, via switch elements with the superposed transport system.

6. Transport and handling system according to claim 4 or 5, characterized in that the two track systems are designed and constructed as overhead suspension systems, the rails of the first track system comprising beams, from which the automated handling device suspends, and the lower flange of which accommodates over portions of the path, in which the rails are combined to a common track, the rails of the second track system, which are formed by hollow sections.

7. Transport and handling system according to claim 6, characterized in that the automated handling device comprises a substantially U-shaped, upwardly open frame, which suspends with one of its legs from the upper flange of the beam, and embraces the transport train suspending from the hollow section.

8. Transport and handling system according to claim 6, characterized in that each transport device comprises a carrying arm traveling on its upper end via rolls in the hollow section and accommodating a package holding means at its lower end, and that each carrying arm comprises a drive coupling element, which is provided on its lateral surfaces extending in the longitudinal direction with guide surfaces for an engagement with a friction roll drive, the coupling elements being designed and constructed such that they form a continuous drive rail with coherent guide surfaces when the transport device are joined to form a train.

9. Transport and handling device according to claim 8, characterized in that the automated handling device accommodates a friction wheel drive engaging with the guide surfaces of the drive coupling elements.

10. Transport and handling device according to claims 8, characterized in that the superposed transport system comprises friction wheel drives, which engage with the guide surfaces of the drive coupling elements of the transport train at least in the region before the junction of the second track system.

11. Transport and handling system according to claim 4 or 5, characterized in that the two track systems are designed and constructed as overhead suspension systems comprising a common beam, from the upper and/or lower flanges of which the automated handling device suspends and is guided on one side of the vertical center plane of the beam, whereas transport devices suspend from the lower flange on the other side of the vertical center plane of the beam.

* * * * *